US005220937A

United States Patent [19]

Roberts et al.

[11] Patent Number: 5,220,937

[45] Date of Patent: Jun. 22, 1993

[54] FREEZE BUSTER

[76] Inventors: Dale W. Roberts, 1190 East Dr., Beaumont, Tex. 77706; George Spector, 233 Broadway Rm. 3815, New York, N.Y. 10007

[21] Appl. No.: 797,370

[22] Filed: Nov. 25, 1991

[51] Int. Cl.[5] ..... F16K 31/64; E03B 7/12

[52] U.S. Cl. ..... 137/62; 122/504; 137/357; 137/365; 138/32; 138/33; 237/80; 417/43

[58] Field of Search ..... 137/59, 61, 62, 107, 137/357, 468, 487.5, 564, 565; 237/80; 417/43, 44, 45; 138/32, 33; 126/420; 122/504

[56] References Cited

U.S. PATENT DOCUMENTS

| | | | |
|---|---|---|---|
| 3,639,081 | 2/1972 | Gray et al. | 417/43 |
| 4,180,088 | 12/1979 | Mallett | 137/459 |
| 4,280,478 | 7/1981 | Duval et al. | 137/61 |
| 4,360,036 | 11/1982 | Shelton | 137/61 |
| 4,672,990 | 6/1987 | Robillard | 137/59 |
| 4,730,637 | 3/1988 | White | 137/62 |
| 4,848,389 | 7/1989 | Pirkle | 137/62 |

*Primary Examiner*—George L. Walton

[57] ABSTRACT

A water freeze prevention device is provided and includes a mechanism that is installed between a water meter and incoming water pipes to drain the water pipes to prevent the water pipes from freezing during severe cold weather conditions.

4 Claims, 1 Drawing Sheet

FREEZE BUSTER

BACKGROUND OF THE INVENTION

The instant invention relates generally to thermally activated valves and more specifically it relates to a water freeze prevention device which provides a mechanism that prevents residential water pipes from freezing.

There are available various conventional thermally activated valves which do not provide the novel improvements of the invention herein disclosed.

SUMMARY OF THE INVENTION

A primary object of the present invention is to provide a water freeze prevention device that will overcome the shortcomings of the prior art devices.

Another object is to provide a water freeze prevention device that is an assembly installed between a water meter and incoming water pipes to prevent the water pipes from freezing during severe cold weather.

An additional object is to provide a water freeze prevention device that will automatically drain the water pipes within a home and discharge the water into the yard, so that the water pipes will become empty and not freeze up.

A further object is to provide a water freeze protection device that is simple and easy to use.

A still further object is to provide a water freeze protection device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
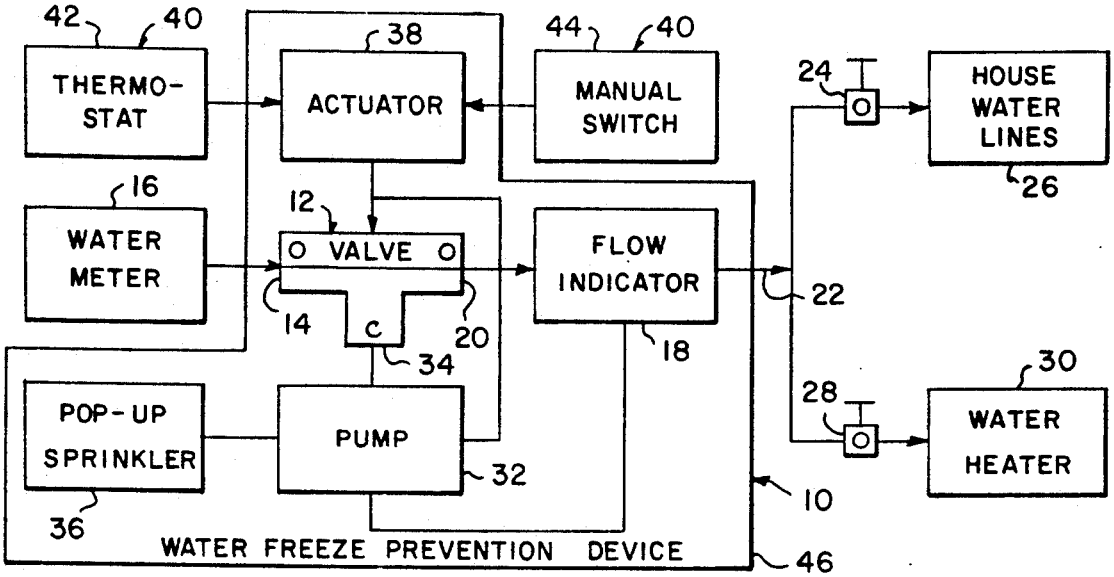
FIG. 1 is a block diagram of the instant invention not in engagement with the water system.
Figure 2:
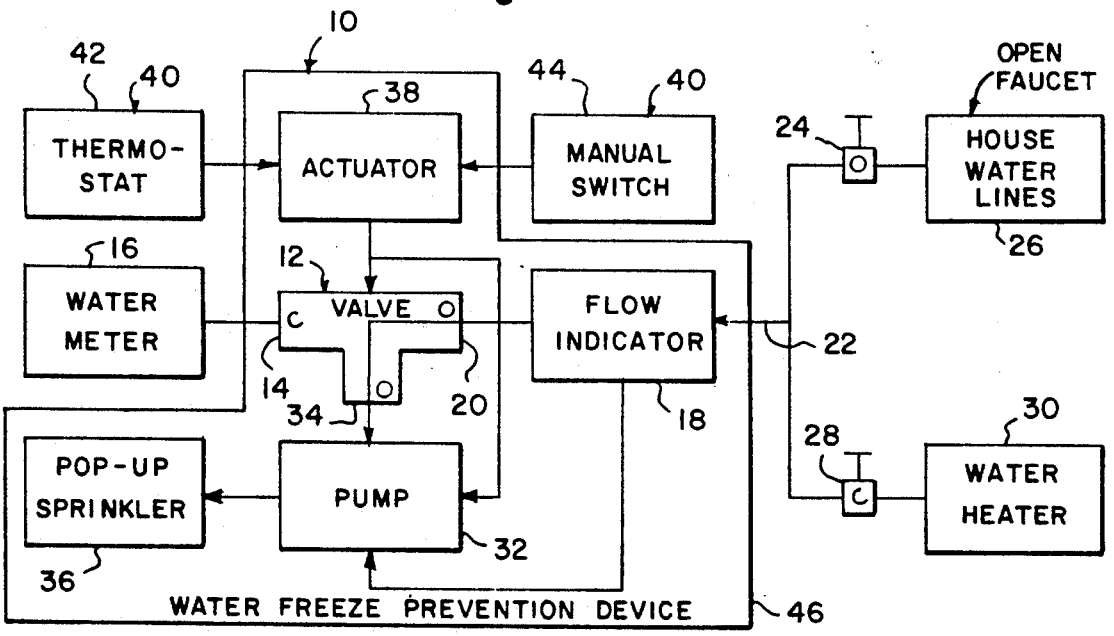
FIG. 2 is a block diagram similar to FIG. 1, but with the instant invention in engagement with the water system, so as to drain the water trapped in the line during the winter to prevent water in the pipes from freezing.
Figure 3:
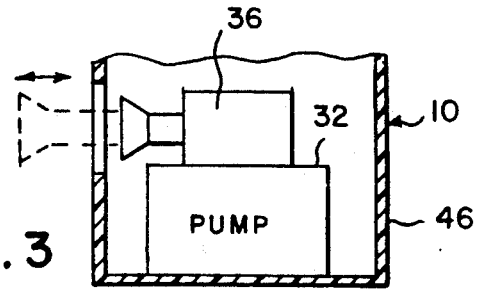
FIG. 3 is a diagrammatic cross sectional side view of a portion of the instant invention showing the pop-up sprinkler in greater detail.

Turning now descriptively to the drawings, in which similar reference characters denote similar elements throughout the several views, the Figures illustrate a water freeze prevention device 10 which consists of a two way flow valve 12 having a first port 14 fluidly communicating with a water meter 16. A flow indicator 18 fluidly communicates with a second port 20 of the two way flow valve 12 and a water pipe 22 that connects to a first valve 24 on house water lines 26 and a second valve 28 on a water heater 30. A pump 32 fluidly communicates with a third port 34 of the two way flow valve 12 and is electrically connected to the flow indicator 18. A pop-up sprinkler 36 fluidly communicates with the pump 32. An actuator 38 is electrically connected to the two way flow valve 12 and the pump 32. A mechanism 40 is for activating the actuator 38.

In a first instance, under normal conditions when the actuator 38 is turned off the first port 14 and the second port 20 are opened, while the third port 34 is closed in the two way flow valve 12. The first valve 24 and the second valve 28 are left opened, allowing the water to flow directly from the water meter 16 through the two way flow valve 12, the flow indicator 18 and into the house water lines 26 and the water heater 30.

In a second instance, during severe cold weather conditions a person will open a faucet in the house water lines 26 and turn off the second valve 28 to the water heater 30. The actuator 30 is then turned on to close the first port 14 and open the third port 20 in the two way flow valve 12, thereby reversing the flow of water through the flow indicator 18 and the two way flow valve 12. The actuator 38 will turn on the pump 32 to remove the water that is within the water pipes 22 which flows through the flow indicator and discharges water through the pop-up sprinkler 36 which disperses the water outside of the house. The pop-up sprinkler is an outlet port fitting which is ejected through housing 46 by the force of water driven by pump 32.

The activating mechanism 40 is a thermostat 42 electrically connected to the actuator 38, so that when the temperature reaches a freezing low level the thermostat 42 will turn on the actuator 38. The activating mechanism 40 is also a manual switch 44 electrically connected to the actuator 38, which can override the thermostat 42, so that a person can turn on and off the actuator 38 when so desired.

The water freeze prevention device 10 further includes a housing 46, such as a PVC box, to encase the two way flow valve 12, the flow indicator 18, the pump 32, the pop-up sprinkler 36 and the actuator 38 therein for rapid installation of the device 10 between the water meter 16 and the house water lines 26 and the line to the water heater 30. Sprinkler 36 is an outlet port which functions to disperse water drained from the house water lines to an area outside of the house.

While certain novel features of this invention have been shown and described and are pointed out in the annexed claims, it will be understood that various omissions, substitutions and changes in the forms and details of the device illustrated and in its operation can be made by those skilled in the ar without departing from the spirit of the invention.

What is claimed is:

1. A water freeze prevention device having an enclosure with an opening in a wall portion thereof for a house which comprises a) a two way flow valve having a first port fluidly communicating with a water meter;

b) a flow indicator fluidly communicating with a second port of said two way flow valve and a water pipe that connects to a first valve on house water lines and a second valve on a water heater;

c) a pump fluidly communicating with a third port of said two way flow valve and electrically connected to said flow indicator;

d) a pop-up sprinkler outlet means fluidly communicating with said pump for dispersing water outside said house;

e) an actuator electrically connected to said two way flow valve and said pump; and f) means for activating said actuator, so that in a first instance under normal conditions when said actuator is turned off said first port and said second port are opened, while said third port is closed in said two way flow valve and the first valve and the second valve are left opened allowing the water to flow directly from the water meter through said two way flow valve, said flow indicator and into the house water lines and the water heater, in a second instance during severe cold weather conditions a person will open a faucet in the house water lines and turn off the second valve to the water heater, said actuator is then turned on to close said first port and open said third port in said two way flow valve, thereby reversing the flow of water through said flow indicator and said two way flow valve, so that said actuator will turn on said pump automatically and the pop-up sprinkler means will be ejected through said opening by the force of water driven by said pump to remove the water that is within the water pipes via the flow indicator and disperse the water through said pop-up sprinkler means outside of said house.

2. A water freeze prevention device as recited in claim 1, wherein said activating means is a thermostat electrically connected to said actuator, so that when the temperature reaches a freezing low level said thermostat will turn on said actuator.

3. A water freeze prevention device as recited in claim 2, wherein said activating means is a manual switch electrically connected to said actuator which can override said thermostat, so that a person can turn on and off said actuator when so desired.

4. A water freeze prevention device as recited in claim 3, wherein said enclosure includes a housing to encase said two way flow valve, said flow indicator, said pump, said pop-up sprinkler means and said actuator therein for rapid installation of said device between the water meter and the house water lines and the line to the water heater.

* * * * *